US012024974B2

(12) United States Patent
Stone et al.

(10) Patent No.: US 12,024,974 B2
(45) Date of Patent: Jul. 2, 2024

(54) ISOLATION AND FILTRATION OBJECT, SYSTEM, AND METHOD

(71) Applicants: Matthew Stone, Humble, TX (US); Colin Andrew, Cypress, TX (US)

(72) Inventors: Matthew Stone, Humble, TX (US); Colin Andrew, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 93 days.

(21) Appl. No.: 17/893,413

(22) Filed: Aug. 23, 2022

(65) Prior Publication Data

US 2024/0068322 A1 Feb. 29, 2024

(51) Int. Cl.

| | |
|---|---|
| ***E21B 33/13*** | (2006.01) |
| ***E21B 29/02*** | (2006.01) |
| ***E21B 33/12*** | (2006.01) |

(52) U.S. Cl.

CPC ..... *E21B 33/13* (2013.01); *E21B 29/02* (2013.01); *E21B 33/12* (2013.01)

(58) Field of Classification Search

CPC ..... E21B 33/13; E21B 29/02; E21B 33/12

See application file for complete search history.

(56) References Cited

U.S. PATENT DOCUMENTS

| | | | | |
|---|---|---|---|---|
| 10,106,730 | B2 * | 10/2018 | Sherman | E21B 43/267 |
| 10,858,579 | B2 * | 12/2020 | Sherman | C09K 8/805 |
| 11,566,171 | B2 * | 1/2023 | Sherman | E21B 43/267 |
| 2005/0011648 | A1 * | 1/2005 | Nguyen | E21B 43/025 166/276 |
| 2010/0006303 | A1 * | 1/2010 | Garcia | F16L 47/02 166/387 |
| 2013/0062061 | A1 * | 3/2013 | Taylor | E21B 33/13 166/288 |
| 2013/0292117 | A1 | 11/2013 | Robisson et al. | |
| 2015/0198008 | A1 | 7/2015 | Smith et al. | |

(Continued)

OTHER PUBLICATIONS

Notification of Transmittal of the International Search Report and the Written Opinion of the International Searching Authority, or the Declaration; PCT/US2023/030702; Mail date: Nov. 23, 2023; 10 pages.

*Primary Examiner* — Steven A MacDonald

(74) *Attorney, Agent, or Firm* — CANTOR COLBURN LLP

(57) ABSTRACT

An isolation and filtration object including a volume of material having a first geometry wherein permeability is relatively lower, the geometry being that of a plug landable on a landing feature and a second geometry where permeability is relatively higher, the second geometry being larger than the first geometry and occupy a flow path in a borehole in which the plug is deployed. An isolation and filtration system including a housing, a plug seat in the housing, and an isolation and filtration object disposable on the plug seat. A borehole system including a borehole in a subsurface formation, a string in the borehole, and an isolation and filtration system connected to the string. A method for operating a borehole including migrating a plug to a seat in a housing, landing the plug in the seat, differentiating pressure across the plug, and transitioning the plug to the second geometry.

19 Claims, 7 Drawing Sheets

(56) References Cited

U.S. PATENT DOCUMENTS

| | | | | |
|---|---|---|---|---|
| 2016/0137912 | A1* | 5/2016 | Sherman | C09K 8/80 166/243 |
| 2018/0037803 | A1* | 2/2018 | Dahi Taleghani | E21B 43/267 |
| 2018/0163125 | A9* | 6/2018 | Sherman | C09K 8/80 |
| 2019/0016951 | A1* | 1/2019 | Sherman | E21B 43/267 |
| 2019/0375978 | A1 | 12/2019 | Shojaei et al. | |
| 2020/0256148 | A1* | 8/2020 | Corbett | E21B 23/0413 |
| 2020/0377790 | A1* | 12/2020 | Sherman | C09K 8/80 |
| 2022/0177769 | A1 | 6/2022 | Fripp et al. | |
| 2023/0174849 | A1* | 6/2023 | Sherman | C09K 8/805 166/243 |
| 2023/0323044 | A1* | 10/2023 | Nommensen | C08J 5/042 524/495 |

* cited by examiner

ISOLATION AND FILTRATION OBJECT, SYSTEM, AND METHOD

BACKGROUND

In the resource recovery and fluid sequestration industries there is often a need to filter fluids flowing into or out of a borehole. Sand screens having a basepipe and a filtration layer at an outside diameter thereof are known to the art but are subject to damage from flow cutting during operations including fracturing. Damage to screens from other borehole processes can sometimes cause marked lost time and profitability. The art therefore will well receive alternatives that reduce the drawbacks of traditional systems.

SUMMARY

An embodiment of an isolation and filtration object including a volume of material having a first geometry wherein permeability is relatively lower, the geometry being that of a plug landable on a landing feature and a second geometry where permeability is relatively higher, the second geometry being larger than the first geometry and occupy a flow path in a borehole in which the plug is deployed.

An embodiment of an isolation and filtration system including a housing, a plug seat in the housing, and an isolation and filtration object as in any prior embodiment disposable on the plug seat.

An embodiment of a borehole system including a borehole in a subsurface formation, a string in the borehole, and an isolation and filtration system connected to the string.

A method for operating a borehole including migrating a plug to a seat in a housing, landing the plug in the seat, differentiating pressure across the plug, and transitioning the plug to the second geometry.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
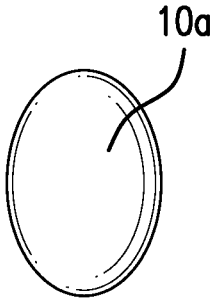
FIG. 1 is a schematic illustration of a first geometry of an isolation and filtration object.
Figure 2:
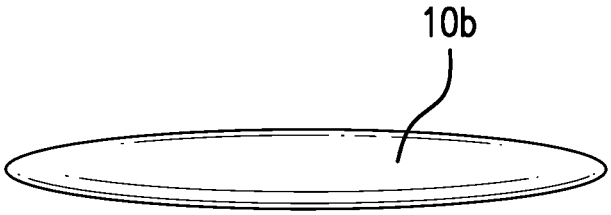
FIG. 2 is a schematic illustration of a second geometry of an isolation and filtration object.

Referring to FIGS. 1 and 2, an isolation and filtration object 10 is illustrated schematically. The object 10 may exist in a first geometry and a second geometry. The first geometry is illustrated in FIG. 1 and the second geometry is illustrated in FIG. 2. Moving from the first geometry 10*a* to the second geometry 10*b* will require an input. The input may be a borehole parameter such as temperature, pressure, time in a borehole fluid, etc., or may be an activation fluid such as, for example, acetyl acetone or a signal (electrical signal, etc.). In the first geometry, there is relatively little, if any, permeability of the volume of material that makes up the object 10. In this geometry, the object 10 is ideal for being conveyed to a seat 12 (see FIG. 3) in a downhole environment, landing there and isolating regions of the borehole downhole of the seat from regions of the borehole uphole of the seat. This means that pressure may be applied to the object 10 against the seat to increase pressure uphole of the seat relative to downhole of the seat. Such activity can be useful in for example the setting of tools and fracturing operations. The object 10 remains in this geometry and relative impermeable condition until the selected input causes the object 10 to transition to the second geometry. In cases where the material of the object 10 is a shape memory material, the second geometry is defined before deployment during a teaching phase of manufacture of the object 10. One stable position will be the second geometry and then that geometry will be physically deformed into the first geometry. The object will then return to the second geometry upon whatever its trigger has be set to be and when that trigger is experienced downhole (through time, temp, pressure or application of activation signal or fluid). It will be appreciated that other materials that are capable of assuming different geometries are also contemplated such as expanding foam materials and swellable materials providing they are capable of also changing their permeability from less to greater when transitioning from the first geometry to the second geometry.

Referring to FIGS. 3-7 an exemplary sequence is illustrated. These figures are not to be interpreted as limiting since each of the elements and actions described with regard to these Figures is necessary in all embodiments contemplated. Rather, what is broadly disclosed is an object and a system that will undergo a selective change from a first geometry having relatively lower permeability to a second geometry having a relatively higher permeability and the effects of such on a borehole system.

Figure 3:
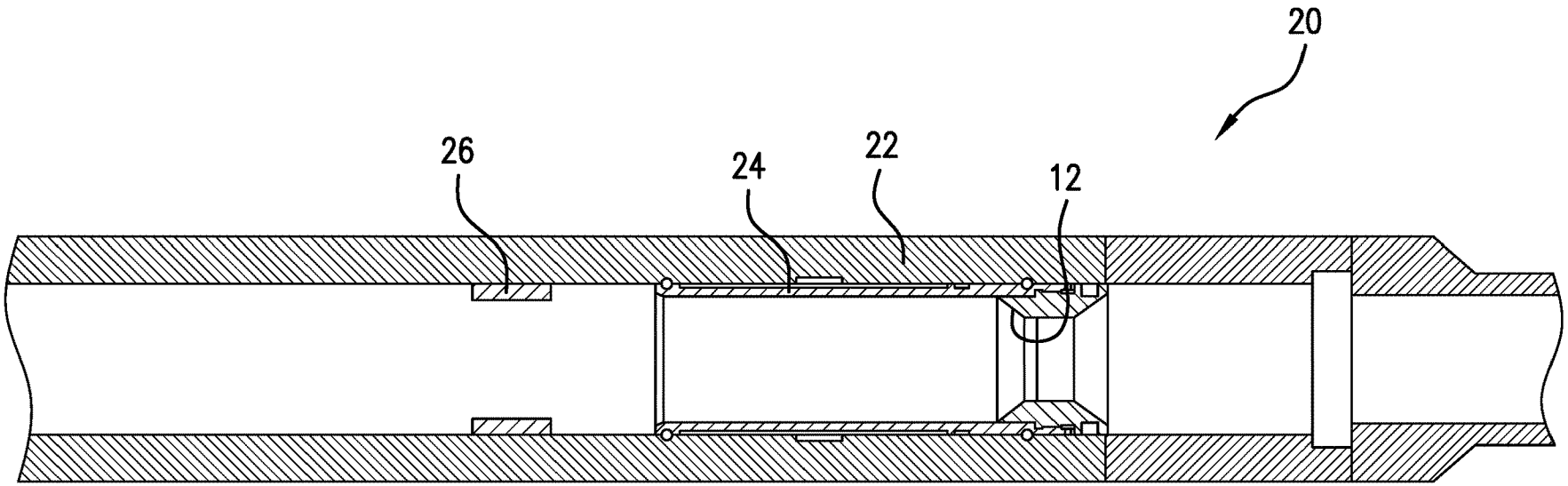
FIG. 3 is a section view of an isolation and filtration system.

FIG. 3 illustrates an embodiment of an isolation and filtration system 20 having a housing 22, a sleeve 24, the seat 12 in the sleeve 24 and a profile 26 that will help anchor the object 10 when in the second geometry. It should be understood that the sleeve 24 and the profile 26 are both optional. It is noted that the housing 22 may also optionally have a port 28, not visible in FIG. 3 but visible in FIG. 4, or the object 10 may simply land on the seat for pressure differential purposes and then transition to the second geometry and filter only the fluids moving in the inside diameter of the housing 22. As to the profile 26, it is characterized as optional since the object 10 in the second geometry is often under strain against the inside diameter of the housing 22 and will stay put regardless of the existence of a profile 26.

Figure 4:
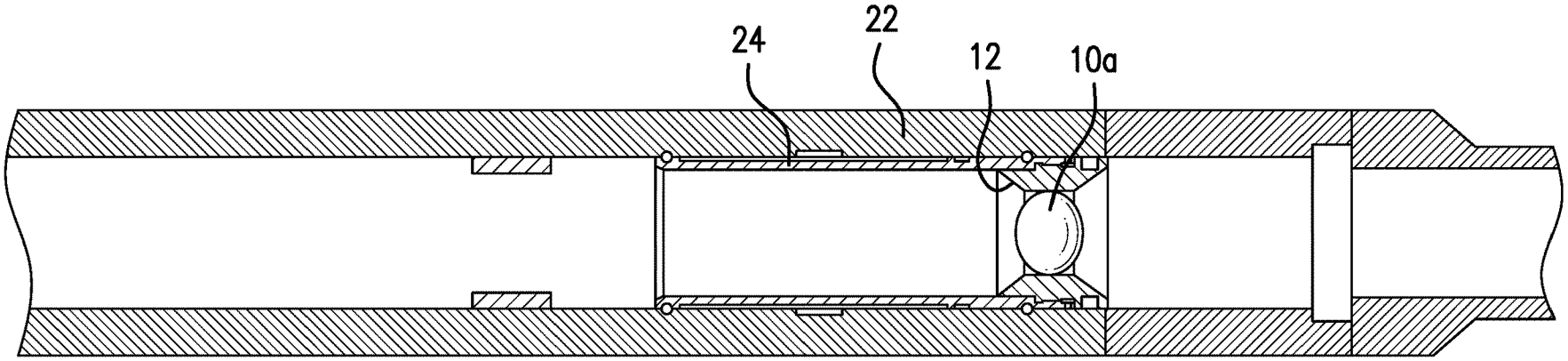
FIG. 4 is the FIG. 3 view with an object in the first geometry disposed therein.
Figure 5:
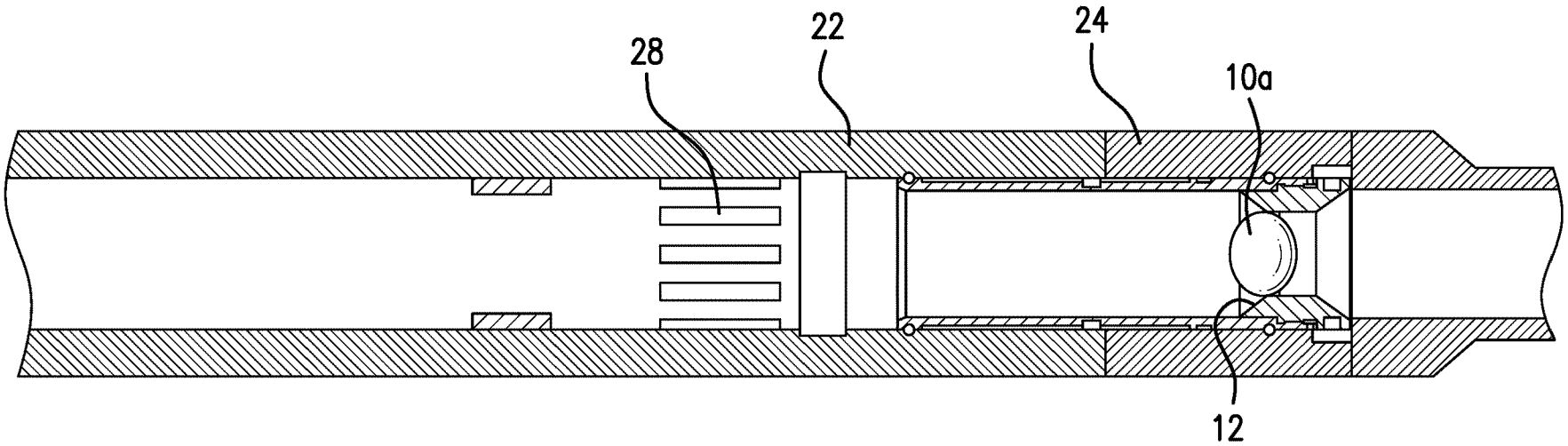
FIG. 5 is the FIG. 4 view with a sleeve shifted by the object.

Referring to FIG. 4, it will be appreciated that the FIG. 3 view has changed only in that the object 10 in the first geometry has landed on the seat 12. The object 10 may be dropped, pumped, etc., to the seat 12. Once on seat 12 the object isolated the borehole downhole of the seat 12 and allows applied uphole pressure to build whereby the seat 12 and sleeve 24 are shifted downhole to reveal the port 28. This is illustrated in FIG. 5. In this position, a fracture job may be performed through the port 28. It is to be appreciated that the configuration removes any concern about damage to a filtration media that would exist in prior art configurations.

This is because the object 10*a* is in a blind sump with little to no fluid movement thereabout. Flow cutting therefore does not occur and as one of skill in the art will recognize, systems where the filtration material is already disposed at the port 28 tend to suffer from rupture due to pressure and flow out through the port 28. This drawback is also avoided in accordance with the teaching hereof. Fracturing in the position of FIG. 5 will only result in fracture fluid and pressure exiting the port 28 as desired and will have no effect on the object 10*a*.

Figure 6:
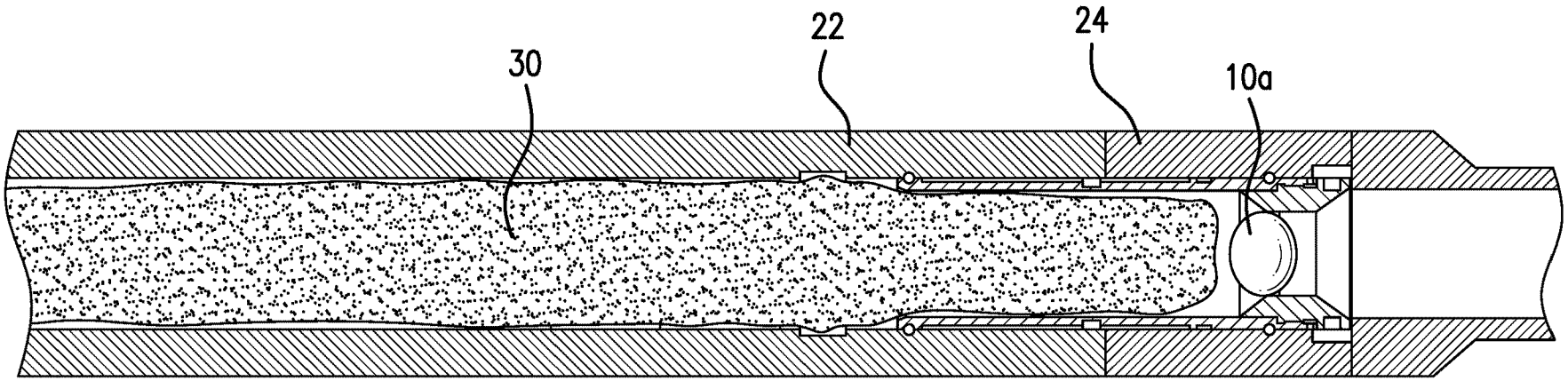
FIG. 6 is the FIG. 5 view with an activation fluid added.
Figure 7:
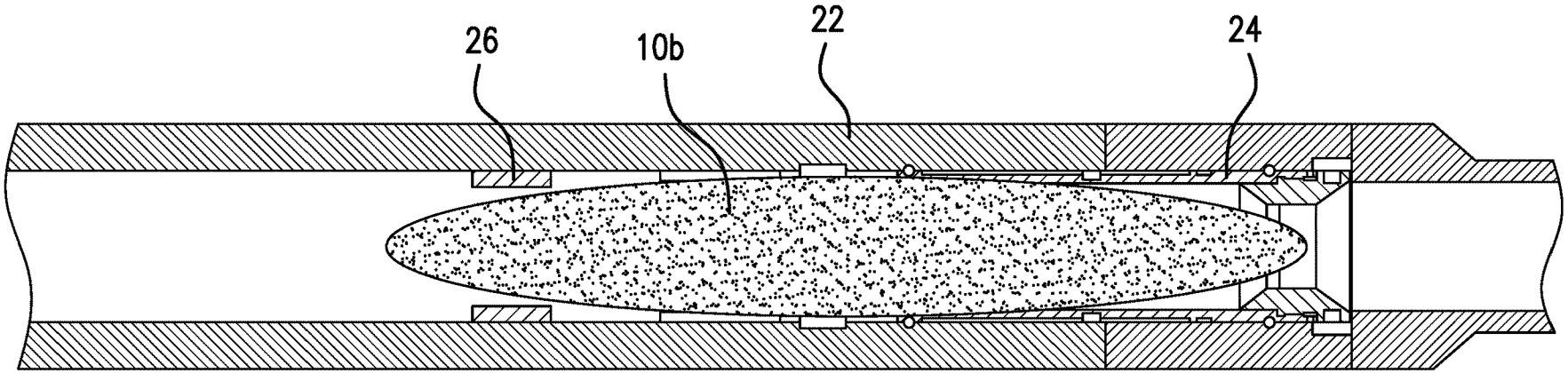
FIG. 7 is the view of FIG. 5 with the object in the second geometry.

Referring to FIG. 6, and subsequent to the fracturing operation, an activation fluid 30 (or other activation input as noted above) is applied to the object 10*a*. This results in a transition of object 10*a* as illustrated in FIG. 7. In FIG. 7, one will appreciate that the object 10 has transitioned from the first geometry of 10*a* in FIG. 1 to the second geometry of 10*b* in FIG. 2. It will also be appreciated that the object 10*b* is occupying the space where any flow through port 28 would have to go and hence will act as a filter for that flow. It can be seen how profile 26 aids in anchoring the object 10*b* in this Figure as well. The material of object 10 in the second geometry, wherein it is vulnerable to flow cutting, etc. does not appear until after operations where flow cutting might be a problem and hence the material is fully protected and fully useful when deployed as object 10*b*.

An additional benefit of the teachings herein is that the filter (object 10*b*) may be easily removed if it becomes less than ideally serviceable. The object 10*b* may be dissolved for example by hydrochloric acid, for example; it may be softened with an activator fluid and pumped in either direction in the borehole to a location out of the way. Then the object 10*b* is easily replaced by conveying another object 10*a* to the seat 12 and signaling transition to a new object 10*b* that will function as the previous object 10*b* did initially.

Figure 8:
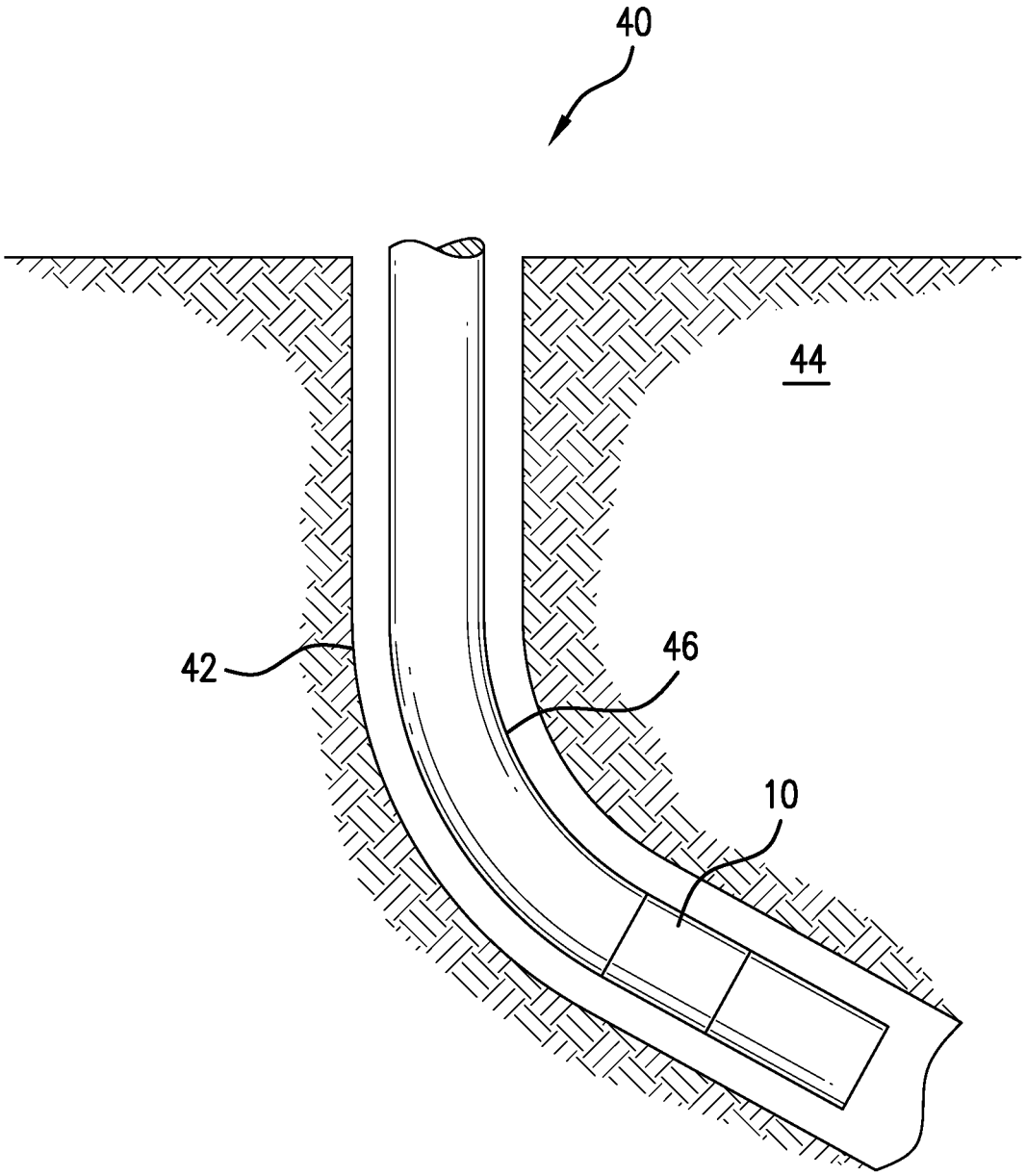
FIG. 8 is a view of borehole system including the isolation and filtration object as disclosed herein.

Referring to FIG. 8, a borehole system 40 is illustrated. The system 40 comprises a borehole 42 in a subsurface formation 44. A string 46 is disposed within the borehole 42. An isolation and filtration object TO as disclosed herein is disposed within the string 46.

Set forth below are some embodiments of the foregoing disclosure:

Embodiment 1: An isolation and filtration object including a volume of material having a first geometry wherein permeability is relatively lower, the geometry being that of a plug landable on a landing feature and a second geometry where permeability is relatively higher, the second geometry being larger than the first geometry and occupy a flow path in a borehole in which the plug is deployed.

Embodiment 2: The object as in any prior embodiment, wherein the plug is a ball.

Embodiment 3: The object as in any prior embodiment, wherein the material is a shape memory material.

Embodiment 4: The object as in any prior embodiment, wherein the shape memory material first geometry is spherical and the second geometry is cigar-shaped.

Embodiment 5: An isolation and filtration system including a housing, a plug seat in the housing, and an isolation and filtration object as in any prior embodiment disposable on the plug seat.

Embodiment 6: The system as in any prior embodiment wherein the housing includes a port extending through a side wall of the housing.

Embodiment 7: The system as in any prior embodiment wherein the plug seat is a part of a sleeve.

Embodiment 8: The system as in any prior embodiment wherein the sleeve in a first position covers the port and in a second position reveals the port.

Embodiment 9: The system as in any prior embodiment wherein the isolation and filtration object is responsive to an input to change from the first geometry to the second geometry.

Embodiment 10: The system as in any prior embodiment wherein the input is an activation fluid.

Embodiment 11: The system as in any prior embodiment wherein the activation fluid is a wellbore fluid.

Embodiment 12: The system as in any prior embodiment wherein the activation fluid is an applied fluid.

Embodiment 13: The system as in any prior embodiment wherein the input is a borehole parameter.

Embodiment 14: A borehole system including a borehole in a subsurface formation, a string in the borehole, and an isolation and filtration system as in any prior embodiment connected to the string.

Embodiment 15: A method for operating a borehole including migrating a plug as in any prior embodiment to a seat in a housing, landing the plug in the seat, differentiating pressure across the plug, and transitioning the plug to the second geometry.

Embodiment 16: The method as in any prior embodiment wherein the transitioning includes applying an input.

Embodiment 17: The method as in any prior embodiment wherein the input is an activation fluid.

Embodiment 18: The method as in any prior embodiment further comprising filtering fluid through the plug.

Embodiment 19: The method as in any prior embodiment wherein the filtering is through a port in a wall of the housing.

Embodiment 20: The method as in any prior embodiment further including causing the plug to disappear and replacing the plug with a new plug comprising a volume of material having a first geometry wherein permeability is relatively lower, the geometry being that of a plug landable on a landing feature; and a second geometry where permeability is relatively higher, the second geometry being larger than the first geometry.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An isolation and filtration object comprising:

a volume of shape memory material having a first geometry and a first permeability, the first geometry being that of a plug landable on a landing feature; and the volume of shape memory material also configured to assume a second geometry having a second permeability, the second permeability being higher than the first permeability, the second geometry having at least one dimension that is larger than the first geometry.

2. The object as claimed in claim 1, wherein the plug is a ball.

3. The object as claimed in claim 1, wherein the shape memory material first geometry is spherical and the second geometry is cigar-shaped.

4. An isolation and filtration system comprising:

a housing;

a plug seat in the housing; and an isolation and filtration object as claimed in claim 1 disposable on the plug seat.

5. The system as claimed in claim 4 wherein the housing includes a port extending through a side wall of the housing.

6. The system as claimed in claim 5 wherein the plug seat is a part of a sleeve.

7. The system as claimed in claim 6 wherein the sleeve in a first position covers the port and in a second position reveals the port.

8. The system as claimed in claim 4 wherein the isolation and filtration object is responsive to an input to change from the first geometry to the second geometry.

9. The system as claimed in claim 8 wherein the input is an activation fluid.

10. The system as claimed in claim 9 wherein the activation fluid is a wellbore fluid.

11. The system as claimed in claim 9 wherein the activation fluid is an applied fluid.

12. The system as claimed in claim 9 wherein the input is a borehole parameter.

13. A borehole system comprising:

a borehole in a subsurface formation;

a string in the borehole; and an isolation and filtration system as claimed in claim 4 connected to the string.

14. A method for operating a borehole comprising:

migrating an isolation and filtration object in the first geometry a plug as claimed in claim 1 to a seat in a housing;

landing the plug in the seat;

differentiating pressure across the plug; and transitioning the plug to the second geometry.

15. The method as claimed in claim 14 wherein the transitioning includes applying an input.

16. The method as claimed in claim 15 wherein the input is an activation fluid.

17. The method as claimed in claim 14 further comprising filtering fluid through the plug.

18. The method as claimed in claim 17 wherein the filtering is through a port in a wall of the housing.

19. The method as claimed in claim 14 further including causing the plug to disappear and replacing the plug with a new plug comprising a volume of material having a first geometry wherein permeability is lower than when the new plug assumed a second geometry, the first geometry being that of a plug landable on a landing feature; and the second geometry having permeability is higher than when the new plug is in the first geometry, the second geometry being larger in at least one dimension than the first geometry.

* * * * *